US008074412B1

(12) United States Patent
Gogan et al.

(10) Patent No.: US 8,074,412 B1
(45) Date of Patent: Dec. 13, 2011

(54) FIRE AND SOUND RESISTANT INSERT FOR A WALL

(76) Inventors: Thomas Gogan, West Union, WV (US); Amanda Gogan, West Union, WV (US)

( * ) Notice: Subject to any disclaimer, the term of this patent is extended or adjusted under 35 U.S.C. 154(b) by 356 days.

(21) Appl. No.: 12/317,672

(22) Filed: Dec. 29, 2008

(51) Int. Cl.
*E04C 2/296* (2006.01)
*E04C 1/40* (2006.01)

(52) U.S. Cl. ..... 52/232; 52/1; 52/241; 52/317; 52/481.2

(58) Field of Classification Search ..... 52/1, 232, 52/243, 282.1, 281, 241, 317, 481.2
See application file for complete search history.

(56) References Cited

U.S. PATENT DOCUMENTS 3,255,563 A * 6/1966 Sauer ..... 52/404.1
3,857,459 A 12/1974 Adams et al.
3,919,444 A 11/1975 Shayman
4,106,249 A * 8/1978 Morton ..... 52/336
4,167,598 A 9/1979 Logan et al.
5,001,883 A 3/1991 Landheer
5,202,174 A 4/1993 Capaul
5,913,788 A * 6/1999 Herren ..... 52/241
6,058,668 A * 5/2000 Herren ..... 52/241
6,216,404 B1 * 4/2001 Vellrath ..... 52/232
7,043,880 B2 * 5/2006 Morgan et al. ..... 52/2.23

* cited by examiner

*Primary Examiner* — Phi Dieu Tran A
(74) *Attorney, Agent, or Firm* — Richard L. Mikesell

(57) ABSTRACT

An element is inserted between the upper edge of a wallboard and a fluted ceiling. The element has a lower edge adapted to snugly accommodate the upper edge of the wallboard and an upper edge shaped and adapted to accommodate the fluted shape of the ceiling. The element is snugly fixed to the wallboard and includes mineral wool and calk fire putty sandwiched between two layers of sheet metal.

3 Claims, 1 Drawing Sheet

FIRE AND SOUND RESISTANT INSERT FOR A WALL

TECHNICAL FIELD OF THE INVENTION

Figure 1:
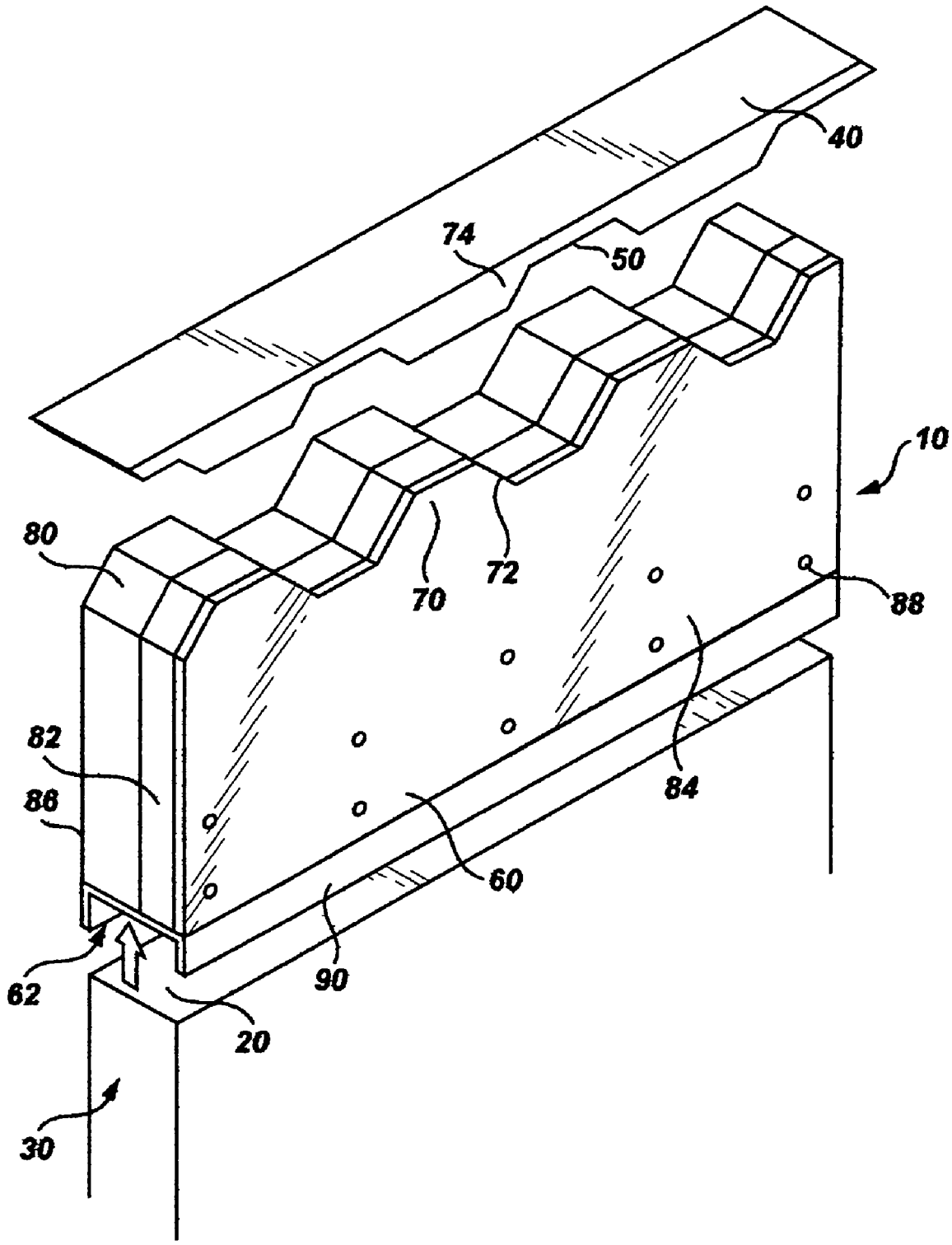

The present invention relates to the general art of static structures, and to the particular field of walls and fire and sound insulation.

BACKGROUND OF THE INVENTION

A problem which continues to exist in building construction is the difficulty in making a nonload-bearing wall adequately fire and sound resistant. In a typical building construction a ceiling is formed by galvanized steel, fluted decking atop which a layer of concrete is poured to form the floor above. The fluted steel decking may, for example, be fabricated of eighteen gauge galvanized steel. The flutes, or concave, downwardly facing channels defined in the underside of the decking, are typically about three inches deep and about six inches wide.

Interior, nonload-bearing walls often pass transversely across the flutes. The beams at the tops of such walls are attached to the underside of the decking where the decking projects downwardly between the hollow flutes. Openings having cross-sectional areas equal to the areas of the flutes are thereby formed above the beams that are located at the top of nonload-bearing, interior walls. These openings form transverse passageways across the tops of the walls through which fire and sound can travel.

To prevent the spread of fire through the flutes formed by the decking above nonload-bearing, interior walls, fire-resistant insulation is packed in the flute openings created at the tops of the walls by the flutes. This fire-resistant insulation may be applied by spraying it into the flute openings from each side of the wall. When the insulation dries and congeals it clogs the flute openings at the top of the wall.

As long as the insulation remains in the flute openings, they remain blocked and the insulation prevents the spread of fire across the top of the wall. However, when a fire is burning within a building, it generates a considerable amount of smoke which is heated and expands. The smoke causes a great pressure within a room where a fire is burning. It is known that the pressure of smoke from a fire burning within a room literally blasts the fire insulation out of the flute openings atop the wall. When this occurs the fire can thereupon spread to an adjacent room over the top of the wall through the flute openings.

According to present building construction practice fire insulation is held within the tunnel cavities defined by the flutes of the decking by hand cutting the upper edges of the gypsum board wall panels to follow the corrugations of the decking. The wallboard panels forming the sides of the nonload-bearing walls provide a series of projections that block the flute tunnels from the opposite sides of the wall and thereby hold the insulation in place. However, this system for holding the insulation in position is extremely time consuming, laborious, and expensive.

Hand cutting of the upper region of the wall to follow the convolutions of the corrugated, fluted decking is extremely labor intensive. The labor cost in creating a scalloped upper edge at the top of the wallboard adds significantly to the cost of construction of the wall. Moreover, even if a template is used the hand cuts result in significant gaps remaining which must then be caulked. The process of caulking is also an extremely laborious, labor intensive process, particularly when it is necessary to follow the convolutions of the underside of the fluted decking.

Moreover, conventional caulking is not seismic resistant. That is, even if the caulking originally provides an effective barrier to air currents, if the building structure subsequently is subjected to seismic activity, the caulking crumbles and gaps that allow the passage of air currents are opened. When this occurs the wall no longer offers its original resistance to the spread of fire. As a result, it has not heretofore been possible to provide both seismic resistance and fire resistance in interior building walls that will meet the stringent building codes applicable to structures such as schools and hospitals.

Therefore, there is a need for a wall structure that will prevent the spread of fire and sound along the flutes of a ceiling, yet is also economical and efficient to install.

SUMMARY OF THE INVENTION

These, and other, objects are achieved by an element that is inserted between the upper edge of a wallboard and a fluted ceiling. The element has a lower edge adapted to accommodate the upper edge of the wallboard and an upper edge shaped and adapted to accommodate the fluted shape of the ceiling. The element includes mineral wool and calk fire putty sandwiched between two layers of sheet metal.

The element seals off the flutes of the ceiling from fire travel by being fastened to the top track. Without this product the installer must stuff the area adjacent to the flutes with insulation and then spray with fire caulk or cut the drywall by hand and again caulk it. The element of the present invention is simply placed and fastened in place. This saves time and effort while effectively preventing both fire and sound spreading between rooms via ceiling flutes.

Other systems, methods, features, and advantages of the invention will be, or will become, apparent to one with skill in the art upon examination of the following FIGURES and detailed description. It is intended that all such additional systems, methods, features, and advantages be included within this description, be within the scope of the invention, and be protected by the following claims.

BRIEF DESCRIPTION OF THE DRAWING FIGURE

The invention can be better understood with reference to the following drawing and description. The components in the FIGURE are not necessarily to scale, emphasis instead being placed upon illustrating the principles of the invention. Moreover, in the FIGURE, like referenced numerals designate corresponding parts throughout the view.

FIG. 1 is a perspective view of an element which is used in a wall to prevent fire and sound propagation between rooms via flutes in a ceiling.

DETAILED DESCRIPTION OF THE INVENTION

Referring to the FIGURE, it can be understood that the present invention is embodied in a means for preventing fire and noise from passing a top edge of a wall via flutes in a fluted ceiling. The means comprises an element 10 that is interposed between the top edge 20 of a wallboard 30 and a ceiling 40 having a plurality of flutes, such as flute 50, defined therein.

Element 10 includes a first end 60 which is a bottom end when the element is in use and which has a channel 62 defined therein to snugly accommodate top edge 20 of the wallboard 30 to hold element 10 securely in place on top of the wallboard. Element 10 further includes a top end 70 that is formed with a plurality of flutes, such as flute 72, that are sized and shaped to snugly accommodate lands 74 located between adjacent ceiling flutes 50 so element 10 will snugly fit between top edge 20 of the wallboard and ceiling 40 in a manner which securely seals off the ceiling areas adjacent to the flutes whereby fire and noise are blocked from passing between the wallboard and the ceiling via the ceiling flutes. The top edge of the element is thus a mirror image of the bottom, fluted, surface of the ceiling element.

Element 10 includes a layer 80 of mineral wool and a layer 82 of meta calk fire putty sandwiched between two layers 84 and 86 of sheet metal. Fasteners, such as screw 88, are used to hold the layers of element 10 together. Channel 62 is formed by a U-shaped channel element 90.

Once a ceiling is installed, element 10 is placed on a wall skeleton to have the flutes 72 accommodate lands 74 of the ceiling and is fastened in place. Wallboards are slid into place with the top edges thereof snugly accommodated in channel 62, and then are fastened in place. The resulting structure is expeditious to erect yet is effective blocking noise and fire from passing between the wallboard and the ceiling via the ceiling flutes.

While various embodiments of the invention have been described, it will be apparent to those of ordinary skill in the art that many more embodiments and implementations are possible within the scope of this invention. Accordingly, the invention is not to be restricted except in light of the attached claims and their equivalents.

What is claimed is:

1. A means for preventing fire and noise from passing a top edge of a wall via flutes in a fluted ceiling comprising:

a unitary element having a first edge that is a top edge when the element is in use and which has a plurality of flutes separated by lands, and a bottom edge which is channel shaped;

the ceiling having a plurality of flutes and a plurality of lands located between adjacent flutes with the flutes of the element being sized and located to snugly accommodate the lands of the ceiling and the lands of the element being sized and shaped to snugly accommodate the flutes of the ceiling, the channel shape of the element being sized to snugly accommodate a wallboard adjacent to a top edge of the wall board to snugly fix the element to the wallboard, the element including a first layer of fire resistant material and a second layer of fire resistant material sandwiched between two layers of steel, said layers of the element being held together by a plurality of fasteners.

2. The means defined in claim 1 wherein the first layer is mineral wool and the second layer is meta calk fire putty.

3. A means for preventing fire and noise from passing a wall structure comprising:

a ceiling element having a plurality of flutes and a plurality of lands located between adjacent flutes; and a wall element having a top edge that is spaced apart from the ceiling element; and a third element having a first edge that is a top edge when the element is in use and which has a plurality of flutes separated by lands, and a bottom edge which is channel shaped, the flutes of the element being sized and located to snugly accommodate the lands of the ceiling and the lands of the element being sized and shaped to snugly accommodate the flutes of the ceiling, the channel shape of the element being sized to snugly accommodate a wallboard adjacent to a top edge of the wall board to snugly fix the element to the wallboard;

the third element further including a layer of mineral wool and a layer of meta calk fire putty sandwiched between two layers of steel and fasteners holding the layers of the third element together.

* * * * *